US010214908B2

(12) United States Patent
Jenkins et al.

(10) Patent No.: US 10,214,908 B2
(45) Date of Patent: Feb. 26, 2019

(54) ROOFING PRODUCT INCLUDING A HEATER

(71) Applicant: CertainTeed Corporation, Malvern, PA (US)

(72) Inventors: Robert L. Jenkins, Honey Brook, PA (US); Stephen A. Koch, Collegeville, PA (US); Gregory F. Jacobs, Oreland, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/203,054

(22) Filed: Mar. 10, 2014

(65) Prior Publication Data

US 2014/0259996 A1 Sep. 18, 2014

Related U.S. Application Data

(60) Provisional application No. 61/780,220, filed on Mar. 13, 2013.

(51) Int. Cl.

| | |
|---|---|
| ***E04D 13/10*** | (2006.01) |
| *E04D 13/04* | (2006.01) |
| *E04D 13/076* | (2006.01) |

(52) U.S. Cl.

CPC ..... *E04D 13/103* (2013.01); *E04D 13/10* (2013.01); *E04D 13/0762* (2013.01); *E04D 2013/0418* (2013.01)

(58) Field of Classification Search

CPC ..... E04D 13/103; E04D 13/10; E04D 13/106; E04D 13/0762; E04D 2013/0418; H05B 3/34; H05B 3/36; H05B 3/342; H05B 3/54; H05B 2203/011; H05B 2214/02

See application file for complete search history.

(56) References Cited

U.S. PATENT DOCUMENTS

| | | | | |
|---|---|---|---|---|
| 2,546,743 A * | 3/1951 | Harrison | ..... | 219/547 |
| 3,521,029 A | 7/1970 | Toyooka et al. | | |
| 3,668,367 A | 6/1972 | Williams | | |
| 3,691,343 A * | 9/1972 | Norman | ..... | 219/213 |

(Continued)

FOREIGN PATENT DOCUMENTS

WO 2012139018 A2 10/2012

OTHER PUBLICATIONS

Heated Roof Systems Ice & Snow Melting System Roof Hearing & Deicing "Radiant Roof Melting System", 4 pgs, Nov. 13, 2012.

(Continued)

*Primary Examiner* — Andrew J Triggs

(74) *Attorney, Agent, or Firm* — Abel Law Group, LLP; Thomas Osborn

(57) ABSTRACT

A roofing product can include a substrate and a heater. The roofing product may be placed along portions of a roof where heat can help to reduce the likelihood of water freezing into ice while along a roof. In an embodiment, a hinge can be used in a roofing product to aid in folding of the roofing product or to retain a non-planar shape of the roofing product. The roofing product may or may not include a self-adhesive backing. A roofing product can include plurality of heaters that can provide sufficient heating should a particular heater fail. Method of fabricating the roofing product can be adapted for a fabrication line that can operate continuously.

3 Claims, 8 Drawing Sheets

(56) References Cited

U.S. PATENT DOCUMENTS

| | | | | |
|---|---|---|---|---|
| 3,904,847 | A * | 9/1975 | Adams | E01C 11/265 219/213 |
| 4,081,657 | A | 3/1978 | Stanford | |
| 4,485,297 | A | 11/1984 | Grise et al. | |
| 4,733,059 | A | 3/1988 | Goss et al. | |
| 5,019,797 | A | 5/1991 | Marstiller et al. | |
| 5,038,018 | A | 8/1991 | Grise et al. | |
| 5,509,246 | A | 4/1996 | Roddy | |
| 5,664,385 | A | 9/1997 | Koschitzky | |
| 5,813,184 | A * | 9/1998 | McKenna | 52/518 |
| 6,166,352 | A * | 12/2000 | Turton | E04D 13/103 219/213 |
| 6,180,929 | B1 * | 1/2001 | Pearce | E01C 11/265 219/213 |
| 6,184,495 | B1 * | 2/2001 | Jones | 219/213 |
| 6,184,496 | B1 * | 2/2001 | Pearce | E01C 11/265 219/202 |
| 6,228,785 | B1 | 5/2001 | Miller et al. | |
| 6,348,673 | B2 * | 2/2002 | Winters | E04D 13/103 219/213 |
| 6,489,594 | B2 * | 12/2002 | Jones | 219/213 |
| 6,727,471 | B2 * | 4/2004 | Evans et al. | 219/213 |
| 7,121,056 | B2 * | 10/2006 | McKenna | 52/518 |
| 7,326,881 | B2 | 2/2008 | Jones | |
| 8,158,231 | B2 | 4/2012 | Hopkins et al. | |
| 8,216,407 | B2 * | 7/2012 | Kalkanoglu et al. | 156/73.1 |
| 8,946,600 | B1 * | 2/2015 | Dupuis | 219/213 |
| 9,095,007 | B2 * | 7/2015 | McGillycuddy | |
| 2001/0032834 | A1 * | 10/2001 | Winters | 219/213 |
| 2002/0152697 | A1 * | 10/2002 | Hokkirigawa et al. | 52/173.1 |
| 2004/0004066 | A1 * | 1/2004 | Evans et al. | 219/213 |
| 2004/0244324 | A1 | 12/2004 | McKenna | |
| 2005/0198917 | A1 * | 9/2005 | Hokkirigawa et al. | 52/173.1 |
| 2005/0199610 | A1 | 9/2005 | Ptasienski et al. | |
| 2006/0289000 | A1 * | 12/2006 | Naylor | E04D 13/103 126/96 |
| 2010/0175824 | A1 | 7/2010 | Hopkins et al. | |
| 2012/0043310 | A1 | 2/2012 | Wuchert | |
| 2012/0198691 | A1 | 8/2012 | Hopkins et al. | |
| 2013/0055661 | A1 * | 3/2013 | McGillycuddy | 52/173.1 |
| 2013/0319990 | A1 | 12/2013 | Casey | |
| 2014/0097178 | A1 * | 4/2014 | Whitcraft | 219/528 |
| 2014/0259996 | A1 * | 9/2014 | Jenkins et al. | 52/173.1 |
| 2014/0263266 | A1 * | 9/2014 | Jenkins et al. | 219/213 |
| 2014/0263267 | A1 * | 9/2014 | Jenkins et al. | 219/213 |

OTHER PUBLICATIONS

Heaterzone.com Roof & Gutter De-Icing Heater Cable "Snow & Ice= Roof & Structure Damage", 5 pgs, Nov. 13, 2012.

* cited by examiner

ROOFING PRODUCT INCLUDING A HEATER

PRIORITY AND RELATED APPLICATIONS

This application claims priority under 35 USC § 119(e) from U.S. Provisional Patent Application No. 61/780,220, filed Mar. 13, 2013, entitled "Roofing Product Including a Heater" naming Robert L. Jenkins as inventor.

This application is related to United States Provisional Patent Application No. 61/780,240, filed Mar. 13, 2013; U.S. patent application Ser. No. 14/203,139, filed Mar. 10, 2014; U.S. Provisional Patent Application No. 61/780,094, filed Mar. 13, 2013; and U.S. Patent Application No. 14/202,020, filed Mar. 10, 2014; all entitled "Roofing Product Including a Heater" by Jenkins et al. filed of even date, which are assigned to the current assignee hereof and incorporated herein by reference in their entireties.

FIELD OF THE DISCLOSURE

The present disclosure relates to roofing products including heaters, and method of forming and installing such roofing products.

RELATED ART

Roofing underlayment can include a heater. The heater may be located over or within the roofing underlayment and can include a set of substantially identical resistive heater elements. With respect to the area of the roofing underlayment occupied by the heater, the heater may be located only below a nailing portion of the underlayment. If needed or desired, a heater may be trimmed to a particular size within a fabrication or other manufacturing facility, so that the heater is sealed within the roofing underlayment. Further, the underlayment may be installed in conjunction with each course of shingles, such that the underlayment for a particular course of shingles overlaps onto a previously installed course of shingles. Further improvements of roofing products with heaters are desired.

BRIEF DESCRIPTION OF THE DRAWINGS

Embodiments are illustrated by way of example and are not limited in the accompanying figures.

Figure 1:
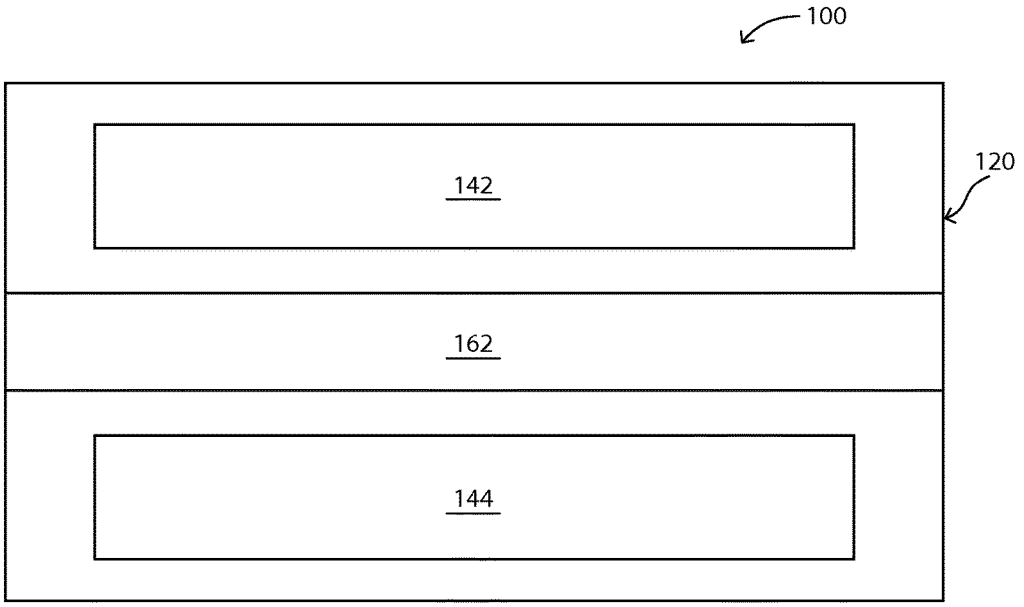
FIG. 1 includes an illustration of a top view of a roofing product including a heater substrate, heater elements, and a hinge.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Before addressing details of embodiments described below, some terms are defined or clarified. The term "heater" is intended to mean a heater element or a plurality of heater elements electrically coupled in parallel to one or more bus bars. Thus, a heater may refer to set of heater elements that are electrically connected along opposite ends by a pair of bus bars or may refer to a particular heater element within the set of heater elements.

The term "principal surfaces," with respect to a roofing product, is intended to mean a pair of opposite surfaces of such roofing product, wherein one of the surfaces lies or would lie farther from a structure to which the roofing product is installed or intended to be installed, and the other surface of such roofing product lies or would lie closer to a structure to which the roofing product is installed or intended to be installed. When installed, the principal surface farther from the structure may be directly exposed to an outdoor environment, and the other principal surface may contact the structure or a different roofing product that lies between the other principal surface and the structure.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the roofing product arts and corresponding manufacturing arts.

Roofing products as disclosed herein can allow for heaters to be placed along portions of a roof where heat can help to reduce the likelihood of water freezing into ice while along the roof. In an embodiment, a hinge can be used in a roofing product to aid in folding of the roofing product or to retain a non-planar shape of the roofing product. Thus, the roofing product is well suited for use in valleys and along hips and ridges of a roof. The roofing product may or may not include a self-adhesive backing. Accordingly, roofing product manufacturers have flexibility in producing roofing products for particular applications. A plurality of heaters can be used to provide sufficient heating should a particular heater fail, such as a bus bar becoming severed or a power line become disconnected from a bus bar. The other heaters can provide sufficient heat to reduce the likelihood that ice will form on the roof even if the particular heater has failed. The roofing product can be installed selectively along portions of the roof. For example, the roofing product including heaters may be installed along only a lower portion of a valley and not along an entire length of the valley, and thus, save money and time by installing the roofing product where it is needed.

Figure 2:
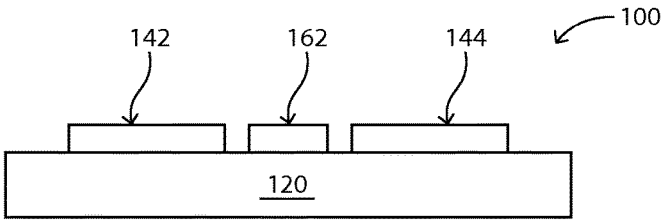
FIG. 2 includes an illustration of a cross-sectional view of the roofing product of FIG. 1.
Figure 3:
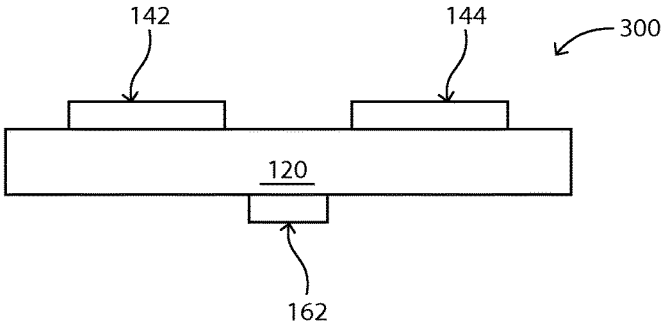
FIGS. 3 and 4 include illustrations of cross-sectional views of alternative embodiments of the roofing product.
Figure 4:
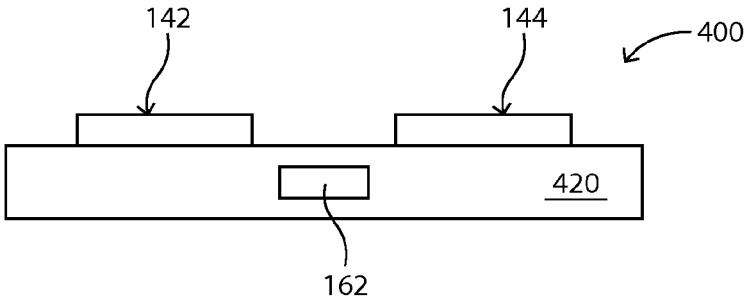

FIG. 1 includes an illustration of a top view of a roofing product 100 that includes a substrate 120, heaters 142 and 144, and a hinge 162 that is spaced apart and disposed between the heaters 142 and 144. FIG. 2 includes an illustration of a cross-sectional view of roofing product to illustrate positional relationships between components of roofing product 100. The heaters 142 and 144 and hinge 162 lie along the same principal surface of the substrate 120. FIG. 3 includes an illustration of a cross-sectional view of another roofing product 300 in which the heaters 142 and 142 lie along a principal surface of the substrate 120, and the hinge 160 lies along an opposite principal surface of the substrate 120. In a further embodiment as illustrated in FIG. 4, a roofing product 400 can include the hinge 162 embedded within the substrate 420. In another embodiment (not illustrated), a hinge may underlie part of all of the heaters 142 and 144. In yet another embodiment (not illustrated), the heaters 142 and 144 may be partly or completely within the substrate. In such an embodiment, the hinge 162 may lie along either principal surface or be partly or completely embedded within the substrate.

The roofing product can be an underlayment, a shingle, a membrane, or the like. The substrate 120 or 420 can be a heater substrate. The heater substrate can provide sufficient mechanical support and withstand heating over normal operating temperatures without melting, delamination from the heater, or other adverse effect. In an embodiment, the heater substrate can be a sheet of a plastic material, for example, a polymer. The polymer can include a polyester, a polyamide, a polyimide, a polyether ether ketone, or a polysulfone. In another embodiment, the heater substrate can include paper or a woven material, such as a polymer fabric, a cotton or wool fabric, or the like. In an embodiment, the heater substrate can have a thickness in a range of approximately 50 microns (2 mils) to approximately 500 microns (20 mils). In a further embodiment, the heater substrate may include any one or more of the substrate materials, have any of the thicknesses, or any combination thereof, as such materials and thicknesses are described in U.S. Pat. Nos. 5,038,018, 8,158,231, and WO 2012/139018A2, which are incorporated herein by reference in their entireties.

The heater substrate may or may not be self-adhesive. FIG. 1 illustrates the substrate 120 that is not self-adhesive. When the heater substrate is not self-adhesive, mechanical fasteners, such as nails, cleats, staples, screws, or the like may be used to attach the heater substrate to a roof deck, a roofing article, or another suitable roofing object. Alternatively, a separate adhesive compound can be applied to the heater substrate or to a roof deck, a roofing article, or another suitable roofing object to which the heater substrate will be attached.

Figure 5:
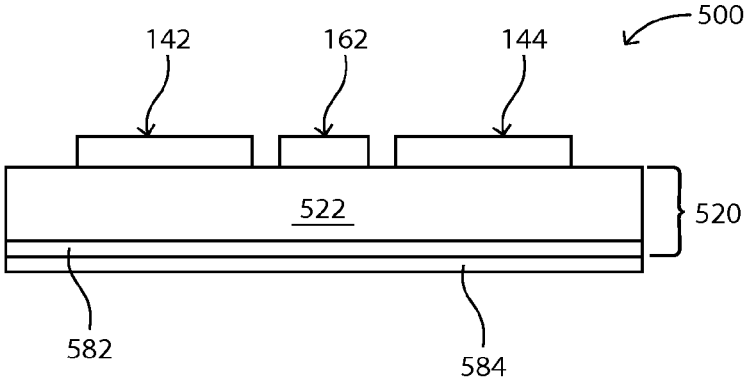
FIG. 5 includes an illustration of a cross-sectional view of a roofing product in accordance with an alternative embodiment.

FIG. 5 includes an illustration of a roofing product 500 having a self-adhesive substrate 520. The substrate 520 that can include a base layer 522 that can be substantially identical to substrate 120, as illustrated in FIG. 5, or may have a composition or thickness different from the substrate 120. The substrate 520 can include a layer 582 of an adhesive material. When the heater substrate is self-adhesive, a release sheet may be used when storing and transporting the heater substrate. The adhesive material can include a silicone, a rubber, an acrylate, a bituminous adhesive, or the like. In a particular embodiment, a styrene-isoprene-styrene rubber composition can be used. The roofing product 500 further includes a release sheet 584 that can help to protect the layer 582 during storage, shipping, and handling of the roofing product 500. The release sheet 584 can be removed when attaching the heater substrate to a roofing article, such as a membrane or other underlayment, a shingle or other roofing article, or to a roofing deck.

Figure 6:
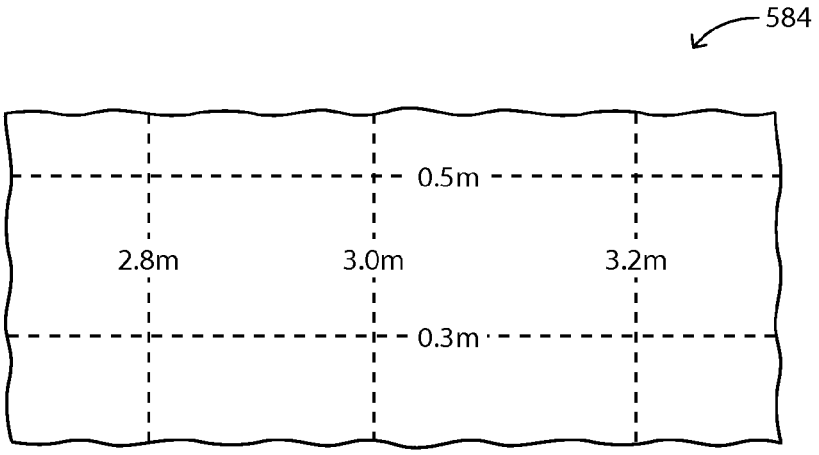
FIG. 6 includes an illustration of the roofing product of FIG. 5 having a release layer with trimmable printed indicia.

The roofing product can include printed indicia to aid in trimming the roofing product. The printed indicia may be on the substrate 120, the base layer 522, or the release layer 584. FIG. 6 includes a bottom view of the roofing product 500 in which the printed indicia are on the release layer 584. In another embodiment, the printed indicia may be visible from the top of the roofing product. The printed indicia can include lines, alphabetic or numerical information, or a combination thereof. In an embodiment, a particular set of lines can be substantially perpendicular to each other. Another set of lines can include lines that intersect the lines of the particular set of lines. The other set of lines can intersect the particular set of lines such that angles defined by the intersections are substantially 90°, such as illustrated in FIG. 6, and in another embodiment can be a different angle, such as substantially 45°, substantially 30°, substantially 60°, or any angle between 0° and 90°. Numerical information, such as illustrated in FIG. 6, may be useful when measuring the size of roofing product before trimming the roofing product before installation.

In another embodiment, the heaters may be formed onto a roofing article without a separate heater substrate. In this embodiment, the heater substrate includes the roofing article. The roofing article can include a roofing substrate, such as fiberglass, polyester, paper, wood, another suitable roofing substrate material or any combination thereof. The roofing article, and thus, the heater substrate, may further include roofing-grade bitumen. The roofing-grade bitumen can be derived from petroleum asphalt, coal tar, recycled roofing product, processed bio oil (for example, vegetable or animal oil), another suitable bitumen source for a roofing article, or any combination thereof. In another embodiment, the roofing article can include a cementitious, ceramic, or a metal, and such roofing articles can be in the form of a tile, sheet metal, another suitable form for attachment to a roof deck, lathes, or slats.

The heater substrate has a thickness sufficient to support the heater elements during the fabrication process and withstand normal shipping, handling, and installation of roofing products. Although there is no theoretical upper limit on the thickness of the heater substrate, practical considerations can limit the thickness of the heater substrate. In an embodiment, the thickness of the heater substrate can be at least approximately 0.01 mm, at least approximately 0.11 mm, at least approximately 0.3 mm, or at least approximately 1.1 mm, and in another embodiment the heater substrate may be no greater than approximately 9 mm, no greater than approximately 5 mm, no greater than approximately 1 mm, or no greater than approximately 0.5 mm. When the heater substrate includes a plastic sheet, the thickness can be in a range of approximately 0.11 mm to approximately 0.5 mm, and where the heater substrate includes a roofing article or a part of a roofing article, the heater substrate can have a thickness in a range of approximately 1 mm to approximately 5 mm.

Figure 7:
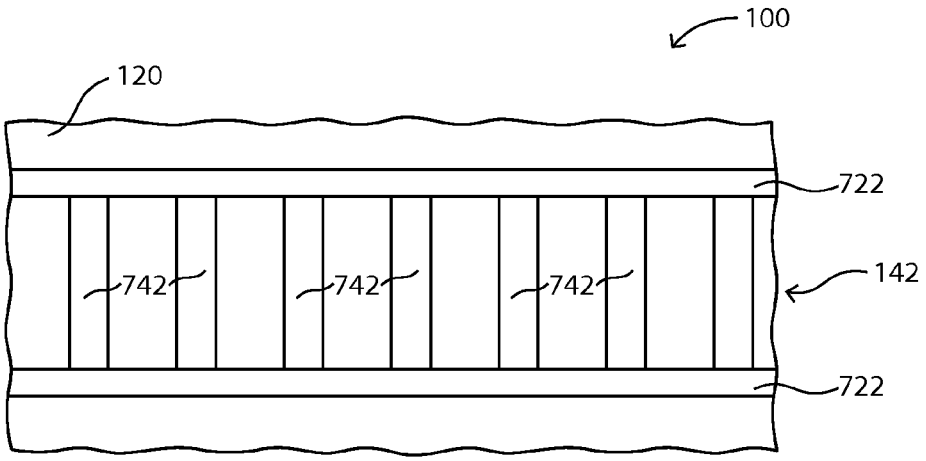
FIG. 7 includes an illustration of a top view of a portion of the heater in the roofing product of FIG. 1.

FIG. 7 includes an illustration of a top view of the heater 142 in accordance with an embodiment. The heater 142 includes bus bars 722 that are coupled to voltage terminals (not illustrated). In a particular embodiment, the bus bars 722 are electrically connected to the voltage terminals. Resistive heater elements 742 are coupled to the bus bars 722. The resistances of the bus bars 722 are substantially lower than the resistive heater elements 742 to allow most of the heating to occur with the resistive heater elements 742, as compared to the bus bars 722. In a particular configuration, the lengths of the resistive heater elements 742 are substantially the same, the space between each of the resistive heater elements 742 are substantially equal, or a combination thereof. In another embodiment, the shapes of the resistive heater elements 742 may be different from one another. The differences in shapes can be differences in lengths, widths, thicknesses, types of shape (straight line, curved line, serpentine pattern, etc.), or any combination thereof. The composition of the components of the heaters and their formation are described in more detail later in this specification. In another embodiment, the compositions for at least two of the heater elements 742 may be different from each other. In a further embodiment, the spacings between the resistive heater elements 742 may be different from one another. The heater 144 can include any of the embodiments as described with respect to the heater 142. The heaters 142 and 144 can be substantially identical or may be different from each other. After reading this specification, skilled artisans will be able to design heaters that meet the needs or desires for a particular application.

Figure 8:
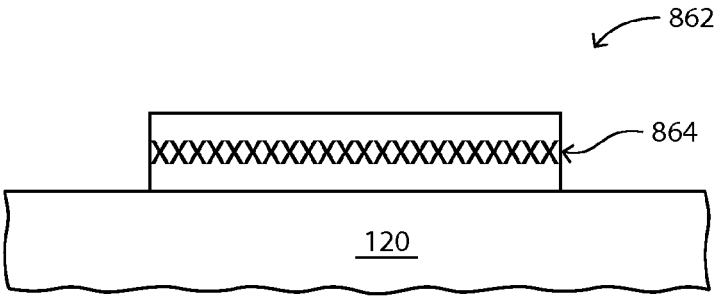
FIGS. 8 and 9 include illustrations of cross-sectional views of hinges.
Figure 9:
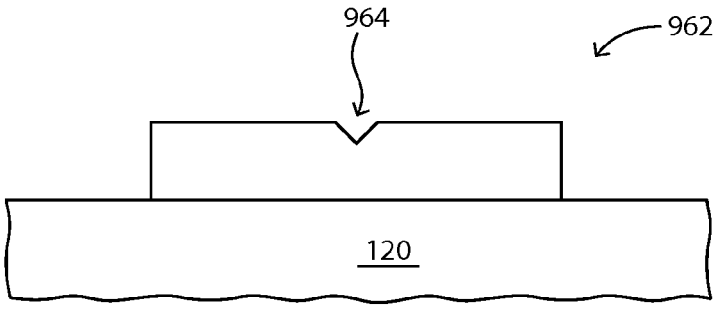

FIGS. 8 and 9 include particular embodiments that can be used for the hinge 162. In FIG. 8, the hinge 862 is provided with a reinforcement member 864 that can be a woven scrim, or woven fabric, for example. The reinforcement could also be a non-woven scrim or fabric, or a film, any of which reinforcements can be embedded into the hinge 862, such as during a molding operation or the like, or could be adhered to either an upper or lower surface of the hinge 862 (not illustrated). In another embodiment, the hinge can include a region with a particular thickness and another region that is thinner than the particular thickness. Such a configuration can be in a form of a cavity to aid in folding or changing the shape of the roof product. In a particular embodiment, the thinner region is closer to the center of the hinge. In FIG. 9, the hinge 962 has a groove 964. The groove 964 is illustrated as having a V-shape. The groove 964 can be formed when the hinge 962 is formed or can be formed after the hinge 962 is formed. For example, the groove 964 can be formed by scoring the hinge 962 with a scoring tool or a sharp object. In another embodiment, the groove 964 can have another shape, such as a U-shape. The groove 964 can allow the hinge 962 to be folded or obtain a non-planar shape in a more predictable manner, as compared to the groove 964 not being present. In another embodiment, the hinge 862 can include a malleable or ductile material or another material that will allow the roofing product to be shaped and to at least partly retain such a shape. In a particular embodiment, the malleable material can be a metal-containing strip having a thickness that can allow for the hinge to be shaped yet still be able to help the roofing product to at least partly retain its shape. The metal-containing strip can include a metal or a metal alloy. Other configurations of the hinge 162 may be used without departing from the concepts as described herein. In an embodiment, the hinge 162 may include an elastomer. U.S. Pat. No. 8,216,407 in incorporated by reference in its entirety, and in particular, for its teachings regarding hinges. After reading this specification, skilled artisans will be able to design a hinge that meets the needs or desires for a particular application.

In a particular embodiment, the heater substrate may be obtained with the hinge incorporated into the heater substrate. For example, the hinge can be positioned and the material for the heater substrate can be formed around the hinge. In another embodiment, the hinge may be positioned between sheets of heater substrate material where the sheets are laminated together. In another embodiment, the hinge can be formed along a surface of or attached to the heater substrate after the heater substrate is formed. The hinge can be formed before or after any one or more of the components of the heater are formed over or within the substrate. When forming the roofing product, the hinge may be substantially planar or may be shaped before, during, or after the hinge is attached to or incorporated into the substrate. A hinge is not required, and therefore, in an alternative embodiment, the roofing product does not include a hinge.

Different fabrication methods may be used to form the roofing product that includes the heater, which may in part depend on the material used for the heater substrate. In one set of embodiments, the heater can be formed onto a plastic sheet or other similar heater substrate. In another set of embodiments, the heater may be formed onto a roofing article, such as a roofing membrane or shingle, or other similar heater substrate.

Figure 10:
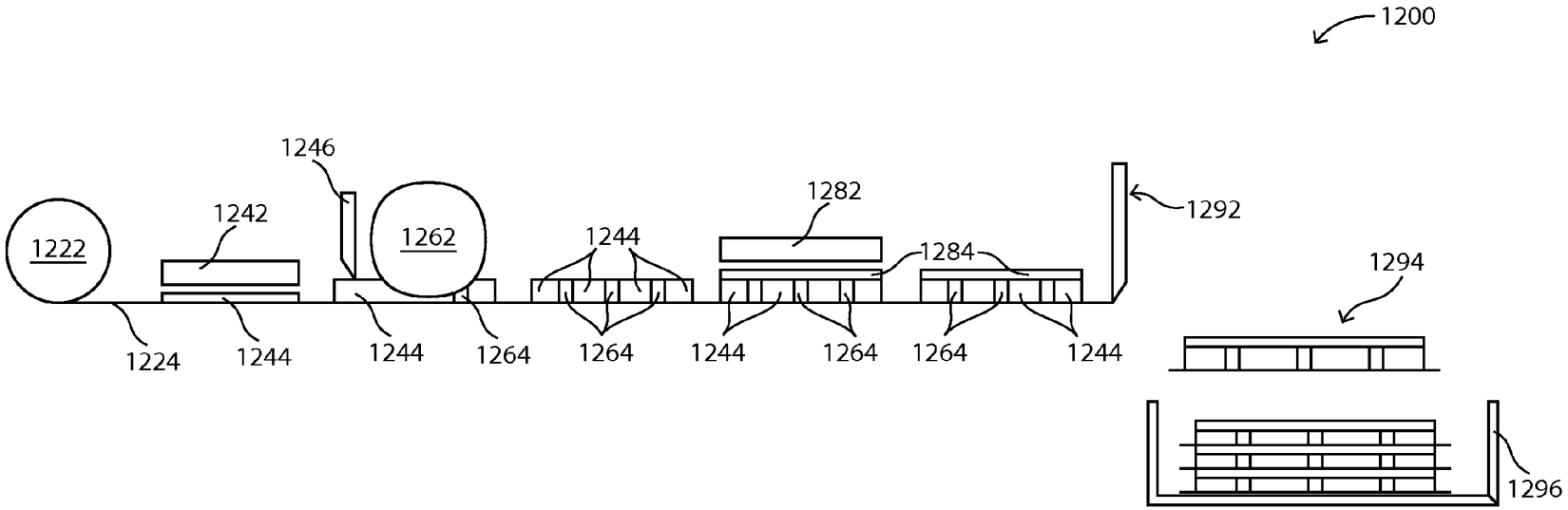
FIG. 10 includes a schematic illustration of a fabrication line for making roofing products in accordance with an embodiment.

FIG. 10 includes a schematic illustration of a simplified fabrication process that can be used to form roofing products that include heaters. In practice, the fabrication process may have more steps, different steps, or the like in order to make a commercial grade roofing product. The schematic illustration is directed to a process in which a heater substrate is provided in roll form. The roofing product can use a roofing article as the heater substrate, and such roofing products will be addressed after describing the fabrication process as illustrated in the embodiment of FIG. 10.

Figure 11:
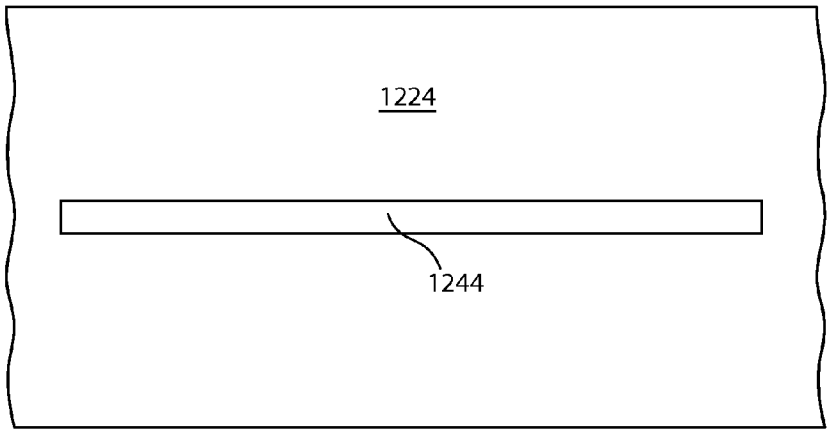
FIGS. 11 to 13 include illustrations of top views of the roofing product at different points along the fabrication line of FIG. 10.

The fabrication line 1200 is well suited for a continuous process flow. The line 1200 can include a roll 1222 of the heater substrate 1224. In an embodiment, the heater substrate 1224 can include a plastic or other flexible material that can get dispensed from the roll 1222. The line can further include a magazine 1242 that provides a hinge 1244 onto the heater substrate 1224. FIG. 11 includes a top view of the roofing product at this point in the process. A scoring tool 1246 can be used to score the hinge 1244. In another embodiment, the scoring or a groove may have been previously formed along the hinge 1244. In a further embodiment, the scoring or groove is not required.

Figure 12:
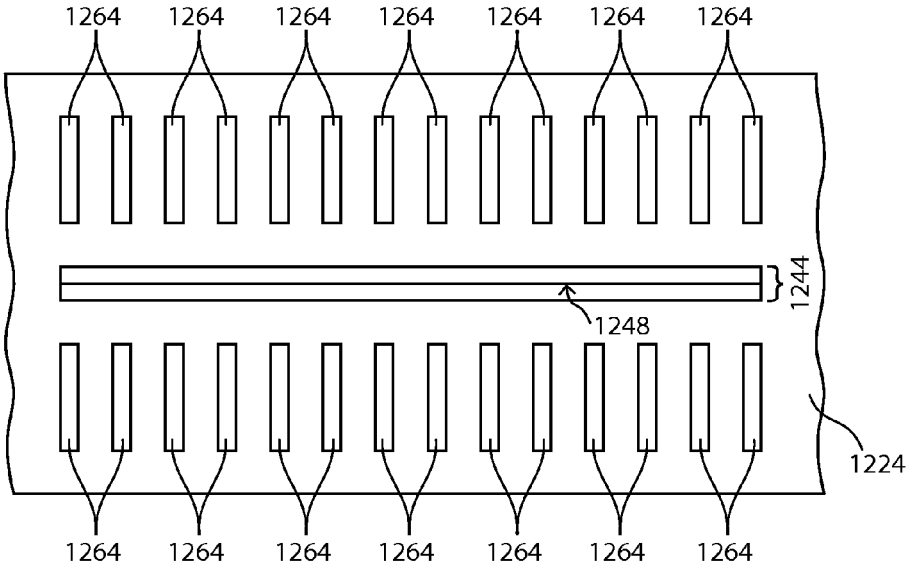

A printing drum 1262 can be used to print heater elements 1264 onto the heater substrate 1224. Although FIG. 10 illustrates only three heater elements 1264 per hinge 1244, more or fewer heater elements 1264 may be formed. FIG. 12 includes a top view of the roofing product after heater elements 1264 have been formed. The hinge 1244 has a scoring line 1248 that extends along substantially all of the length of the hinge 1244. In another embodiment, the scoring line 1248 may extend along only part of the length of the hinge 1244. The heater elements 1264 are disposed along opposite sides of the hinge. The heater elements 1264 may be substantially identical to one another, and in another embodiment, at least two different shapes or sizes of heater elements 1264 may be used.

In a particular embodiment, the circumference of the printing drum 1262 can correspond to the length of the roofing products being formed. In this matter, each rotation of the printing drum 1262 corresponds to a roofing product. In another embodiment, the circumference of the printing drum 1262 may correspond to an integer number of roofing products (for example, two, three, etc.) or an integer number of rotations of the printing drum 1262 may correspond to one roofing product. Alternatively, the circumference of the drum may correspond to a fractional length of a roofing product, the fraction being either greater or less than one. After reading this specification, skilled artisans will be able to determine a size of the printing drum 1262 that best meets the needs or desires for a particular application.

Figure 13:
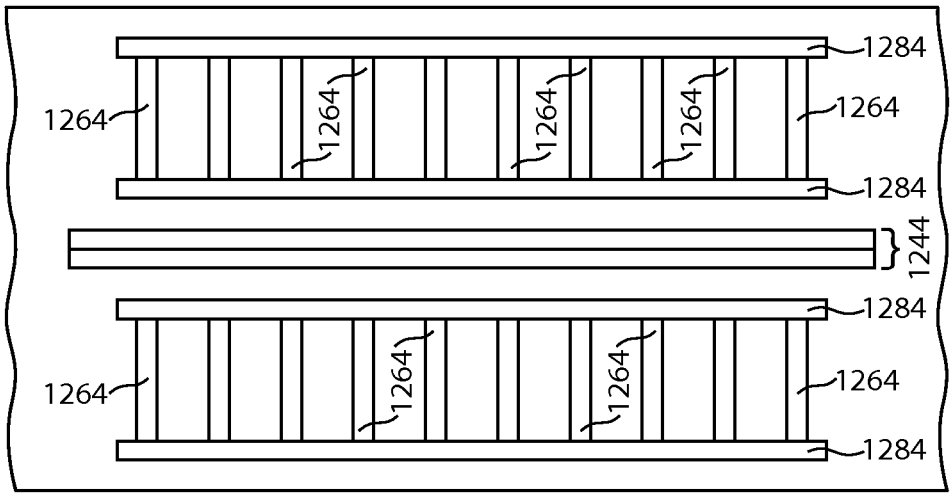

One or more magazines, such as magazine 1282, provide bus bars 1284 that make electrical connections between the heater elements 1264. FIG. 13 includes a top view of the roofing product after bus bars 1284 have been placed over portions of the heater elements 1264 and the heater substrate 1224. Two heaters are illustrated in FIG. 13, wherein the hinge 1244 is disposed between the heaters. The bus bars 1284 connect the heater elements 1264 in parallel and provide current to the heater elements 1264. The bus bars 1284 are illustrated as being substantially identical to one another, and in another embodiment, at least two different shapes or sizes of bus bars 1284 may be used.

A cutter 1292 can be used to cut the heater substrate 1224 to form individual roofing products 1294 that can be collected in a hopper 1296 or a different handling or storage container. Alternatively, the individual roofing products 1294 are collected and packaged for shipping and distribution (not illustrated. The cutter 1292 can be in the form of a sharp blade moving in a vertical direction, a transverse direction, or a combination thereof. Additional processing may be performed to form a substantially completed roofing product.

The fabrication line 1200 can be modified to allow different processing. The hinge 1244 may not be used or may be attached to the roofing products or roofing deck at or near the time the roofing products are installed.

The heater elements 1264 can be formed using stencil printing technique, such as screen printing or a deposition technique using a shadow mask. By using the printing drum 1262, the heater elements 1264 can be formed in a repetitious pattern over the heater substrate 1224 using a continuous process. The outer circumference includes a stencil mask that is to be placed adjacent to the heater substrate 1224, where the openings in the stencil mask corresponds to locations where the heater elements 1264 are formed. A layer is deposited over the stencil mask and the heater substrate 1224. The heater elements 1264 are formed on the heater substrate 1224 and have shapes that correspond to the openings in the stencil mask. The printing drum 1262 may be replaced by a screen printer or a raster printer. A heater or curing machine may be used to dry or cure the heater elements 1264 before the heater substrate 1224 is cut.

In another embodiment, a protective sheet could be placed over the hinge 1244, the heater elements 1264, and the bus bars 1284 before or after the heater substrate 1224 is cut by the cutter 1292. In a further embodiment, an adhesive layer and a release sheet can be applied to the heater substrate 1224 during fabrication. In still another embodiment, the roll 1222 may be supplied with the adhesive layer and release sheet attached to the heater substrate.

More complex printing may be used. A printer can programmed to selectively dispense an electrically resistive ink. In a more particular embodiment, the printer can include a printing head that can dispense an electrically resistive ink. In a particular embodiment, more than one printing head may be used. A plurality of printing heads can be useful to print a plurality of heater elements substantially simultaneously. In another embodiment, at least two different printing heads have different compositions that have different electrical resistivities. In another embodiment, the printing head can raster across the heater substrate during printing. Printing techniques are well suited for forming the heater elements because the pattern for the heater elements can be repeated, and a relatively continuous heater substrate can be used and later cut or otherwise separated into a needed or desired size.

In a further embodiment, the heater elements 1264 can be formed by coating or otherwise depositing an electrically resistive layer over the heater substrate 1224, and patterning the electrically resistive layer to define the heater elements 1264. In still another embodiment, the heater elements 1264 can be formed separately from the heater substrate 1224 and placed over the heater substrate 1224.

In another embodiment, the fabrication line 1200 may produce roofing articles, such as shingles or membranes. In this embodiment, the roll 1222 can include a material used as a base material within a roofing article, such as a fiberglass mat, paper, polyester, or the like. Other equipment and steps (not illustrated in FIG. 10) can include a bitumen coater, roofing granules application, or the like. After reading this specification, skilled artisans will appreciate that there is substantial flexibility to configure a fabrication line for a particular application to make particular types of roofing products.

The roofing products as previously described can be installed over a roof deck. The roofing products can be used for many different areas of a roof and are particularly well suited for valleys, hips, ridges, and other areas where different portions of the roof deck intersect each other.

Figure 14:
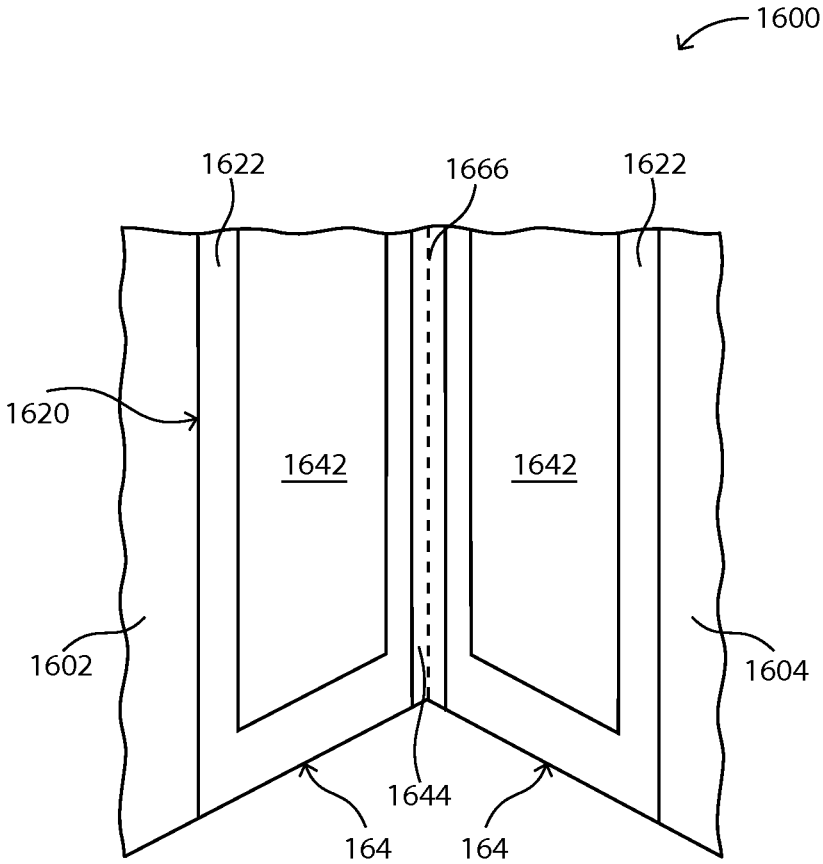
FIG. 14 includes an illustration of a top view of a portion of a roof, wherein a roofing product has heater elements adjacent to a hinge that overlies an intersection of different portions of the roof.

FIG. 14 includes an illustration of a roof 1600 after a roofing product 1620 has been installed over a roofing deck along an intersection 1666 of two different portions 1602 and 1604 of the roof 1600 that define a valley. The intersection 1666 is a valley centerline that extends from the eaves 164 up towards a higher elevation of the roof 1600. The roofing product 1620 includes a heater substrate 1622, heaters 1642, and a hinge 1644 that overlies a centerline of the roofing product 1620. The roofing product 1620 is installed such that the hinge 1644 is positioned over the intersection 1666. In a particular embodiment, the centerline of the roofing product 1620 extends along a length of the roofing product 1620 and is substantially parallel to the intersection 1666. The hinge 1644 can help to aid in folding or retaining a shape that corresponds to the intersection 1666 of the different portions 1602 and 1604 of the roof 1600. Each of the heaters 1642 extend no greater than 15 cm from the intersection 1666 and the product centerline.

Figure 15:
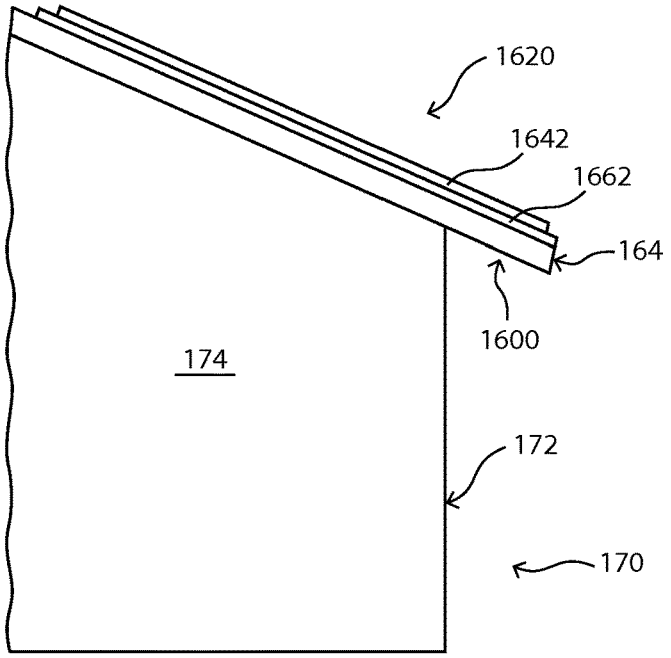
FIG. 15 includes an illustration of a side view of the roof, wherein the roofing product extends only partly, and not completely, along the intersection.

The roofing product 1620 can be installed such that it extends from the eaves 164 and a bottommost point of the intersection 1666 to a location that is further along the intersection 1666. The roofing product may or may not extend along the entire length of the intersection 1666. Referring to FIG. 15, the portion of the roof 1600 extends beyond an exterior wall 172 of a structure 170 having the roof 1600. Such a portion of the roof 1600 may be relatively cold, as it does not overlie the interior portion 174 of the structure 170. Further, ice may be more likely to form within the valley, and thus, the heaters 1642 can help to increase the local temperature and reduce the likelihood that water within the valley will freeze. From a top view, the roofing product 1620 can extend from the eave 164 and over the exterior wall 172 and a portion of the interior 174 of the structure 170. In an embodiment, the roofing product 1620 can extend at least approximately 0.2 meters beyond the exterior wall 172 and over the interior 174 of the structure 170. The need for heat farther up (higher in elevation) along the intersection may be less. Thus, the roofing product 1620 may extend along only a portion, and not all, of the intersection 1666, and therefore, the roofing product 1620 or the heaters 1642 of the roofing product 1620 may be spaced apart from an uppermost point of the intersection. The roofing product 1620 may have a length in a range of approximately 2 meters to approximately 5 meters, and in a particular embodiment, in a range of approximately 3 meters to approximately 4 meters. In another particular embodiment, the point may be no more than 1 meter from the exterior wall.

Figure 16:
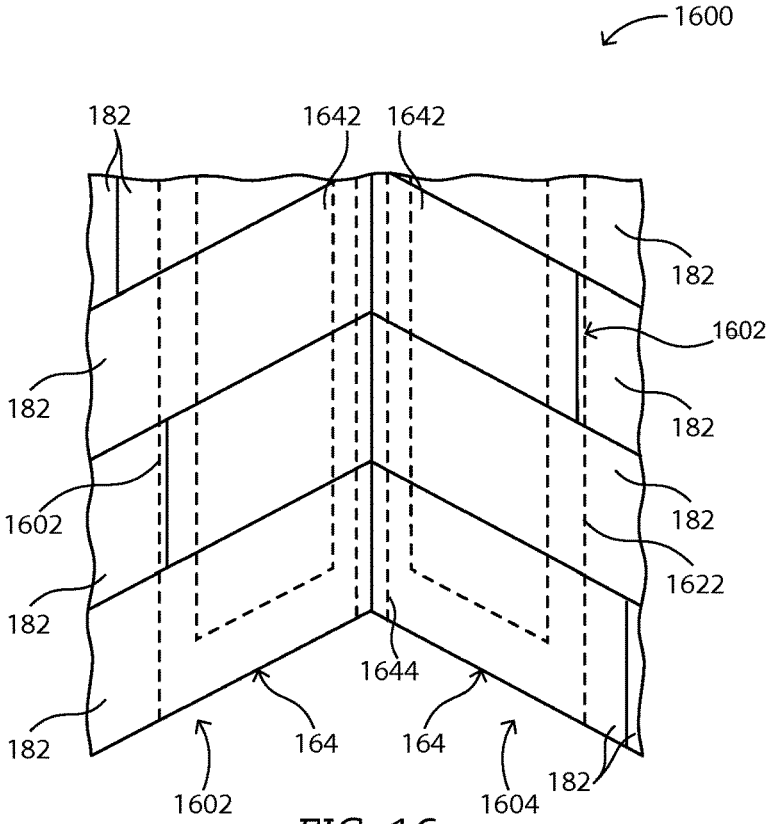
FIG. 16 includes an illustration of a top view of the roof of FIG. 14 after shingles are installed over the roofing product.

FIG. 16 includes an illustration after courses of shingles 182 have been installed over the roof 1600 and the roofing product 1620. Dashed lines are used to illustrate the position of the roofing product 1620 and its components with respect to the shingles 182. In the embodiment illustrated, the lengths of the heaters 1642 are greater than approximately 0.5 times the height of the courses of shingles 182, and in another embodiment, the lengths of the heaters 1642 are at least approximately 20 cm. Each of the shingles 182 can be fastened to the roofing deck 1602 or 1604 using any of the fasteners previously described with respect to the roofing product 1620. The fasteners can extend through the heater substrate 1622 but may not extend through the heaters 1642.

Figure 17:
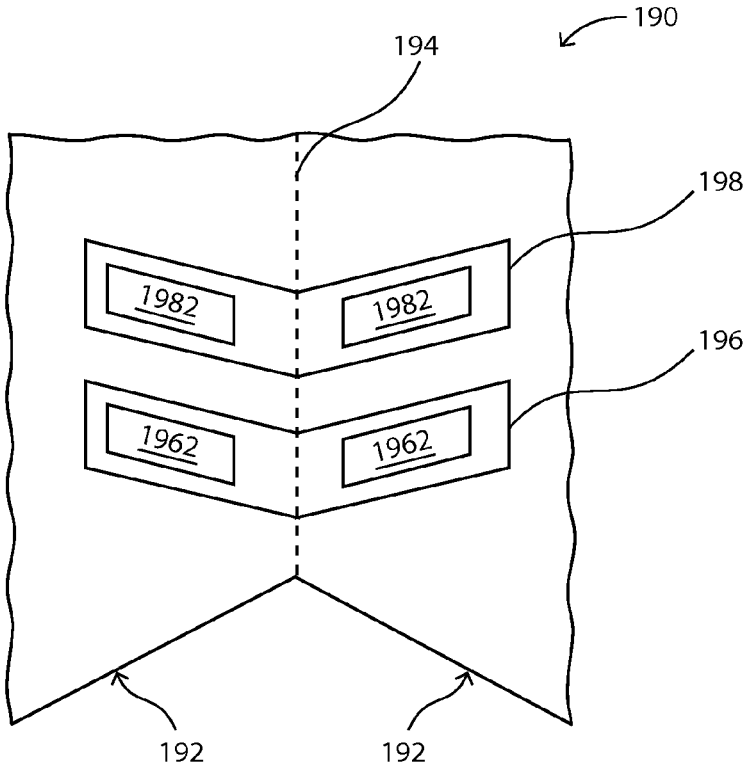
FIG. 17 includes an illustration of a top view of portions of a roof, wherein a roofing product has heater elements adjacent to an intersection of the portions of the roof in accordance with another embodiment.

FIG. 17 includes an illustration of a roof 190 that includes roofing products 196 and 198 that have heaters 1962 and 1982. The roofing product 196 is installed over a roofing deck along an intersection of two different portions of the roof 190. The intersection defines a valley centerline, as illustrated by a dashed line 194 in FIG. 17. In an embodiment, the intersection extends from the eaves 192 up towards a higher elevation of the roof 190. In the embodiment as illustrated in FIG. 17, the centerline of the roofing product 196 extends along a width of the roofing product 196 and is substantially parallel to the intersection 194.

Figure 18:
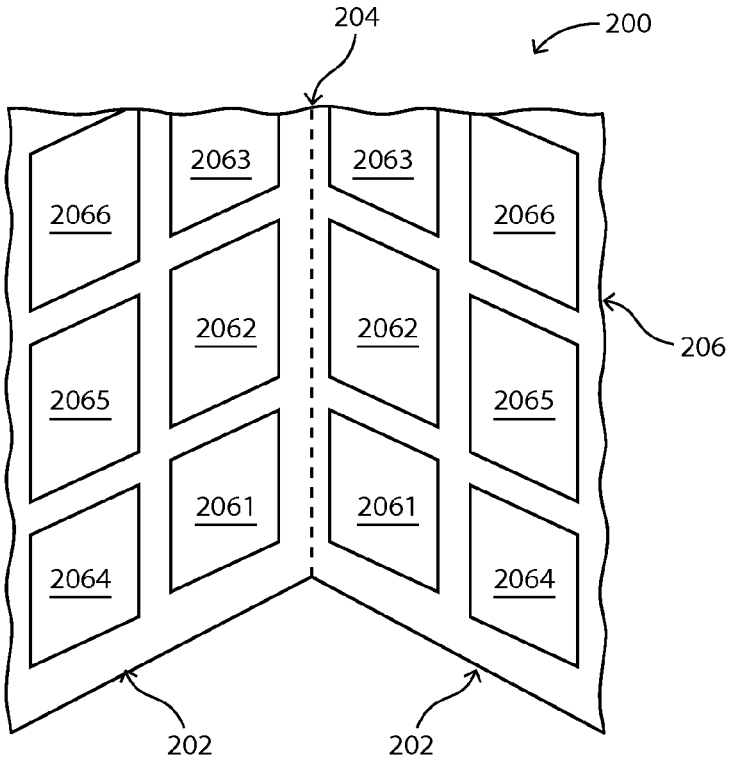
FIG. 18 includes an illustration of a top view of portions of a roof, wherein a roofing product has a plurality of heater elements adjacent to each side of an intersection of the portions of the roof in accordance with another embodiment.

FIG. 18 includes an illustration of a roof 200 that includes a roofing product 206 that has a plurality of heaters. The roofing product 206 is installed over a roofing deck along an intersection 204 of two different portions of the roof 200. The roofing product 206 includes heaters 2061, 2062, 2063, 2064, 2065, and 2066. The roofing product 206 can allow for a particular heater to fail while the remaining heaters can help to keep water from turning into ice while over the roof 200. The spacing between the columns of heaters along the same portion of the roof (on the same side of the intersection 204) can allow for a nail zone. The dimensions of the heaters as measured in a direction from the eave 202 to the top of the roof 200 may or may not be longer than a course of shingles.

In the embodiment as illustrated in FIG. 18, some of the heaters may be replaced by a single heater that occupies more area than a heater that such a single heater replaces. Different shapes of heaters may be achieved when replacing a larger heater with smaller heaters. For example, heaters 2061, 2062, and 2064 on each side of the intersection 204 may be replaced with L-shaped heaters. Care may need to be used to ensure nails or other fasteners are not driven through heater elements, bus bars, or other electrical components for the heaters. In another embodiment, heaters 2062 and 2064 on each side of the intersection 204 may be replaced by heaters that lie along diagonal directions as compared to the eaves. In further embodiment, more heaters than illustrated may be used. After reading this specification, skilled artisans will be able to determine the number of heaters and size for their particular application.

The roofing products as disclosed herein can allow for heaters to be placed along portions of a roof where heat can help to reduce the likelihood of water freezing into ice while along a roof. A hinge can be used in a roofing product to aid in folding of the roofing product or to retain a non-planar shape of the roofing product. Thus, the roofing product is well suited for use in valleys and along hips and ridges of a roof. The roofing product may or may not include a self-adhesive backing. Accordingly, roofing product manufacturers have flexibility in producing roofing products for particular applications. A plurality of heaters can be used to provide sufficient heating should a particular heater fail, such as a bus bar becoming severed or a power line become disconnected from a bus bar. The other heaters can provide sufficient heat to reduce the likelihood that ice will form on the roof even if the particular heater has failed. The roofing product can be installed selectively along portions of the roof. For example, the roofing product including heaters may be installed along only a lower portion of a valley and not along an entire length of the valley, and thus, save money and time by installing the roofing product where it is needed the most.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Item 1. A roofing product can include a substrate, a first heater disposed along a principal surface of or within the substrate, and a hinge configured to aid in folding or retaining a non-planar shape of the roofing product.

Item 2. The roofing product of Item 1, wherein the first heater is spaced apart from the hinge.

Item 3. The roofing product of Item 1, further comprising a second heater, wherein the hinge is disposed between the first and second heaters.

Item 4. The roofing product of Item 1, wherein the hinge comprises an elastomer.

Item 5. The roofing product of Item 1, wherein the hinge comprises a reinforcement member.

Item 6. The roofing product of Item 5, wherein the reinforcement member comprises a woven scrim or a woven fabric.

Item 7. The roofing product of Item 1, wherein the hinge is scored or has a groove.

Item 8. The roofing product of Item 1, wherein the hinge has a first region having a first thickness and a second region having a second thickness that is greater than the first thickness.

Item 9. The roofing product of Item 8, wherein a center of the hinge is within the first region than the second region.

Item 10. The roofing product of Item 1, wherein the hinge comprises a cavity that is configured to aid in folding the roofing product.

Item 11. The roofing product of Item 1, wherein the hinge comprises a metal-containing strip.

Item 12. The roofing product of Item 11, wherein the metal-containing strip comprises a malleable metal or malleable metal alloy.

Item 13. The roofing product of Item 11, wherein the metal-containing strip comprises aluminum or copper.

Item 14. The roofing product of Item 1, wherein the substrate comprises a polyester, a polyamide, a polyimide, a polyether ether ketone, or a polysulfone.

Item 15. The roofing product of Item 1, wherein the first heater comprises heating elements.

Item 16. The roofing product of Item 15, wherein the heating elements comprise an electrically resistive ink Item 17. The roofing product of Item 15, wherein the heating elements comprise a metal or a metal alloy.

Item 18. The roofing product of Item 15, further comprising a first bus bar and a second bus bar spaced apart from the first bus bar, wherein the heating elements are coupled to the first and second bus bars.

Item 19. The roofing product of Item 18, wherein the first bus bar is electrically connected to first ends of the heating elements, and the second bus bar is electrically connected to second ends of the heating elements that are opposite the first ends.

Item 20. A roofing product can include a substrate and a heater disposed along a principal surface of or within the substrate, wherein the roofing product does not have a self-adhesive backing.

Item 21. The roofing product of Item 20, wherein the roofing product has a length in a range of approximately 2 meters to approximately 5 meters.

Item 22. The roofing product of Item 21, wherein the length is in a range of approximately 3 meters to approximately 4 meters.

Item 23. The roofing product of Item 20, wherein the substrate comprises a polyester, a polyamide, a polyimide, a polyether ether ketone, or a polysulfone.

Item 24. The roofing product of Item 20, wherein the first heater comprises heating elements.

Item 25. The roofing product of Item 24, wherein the heating elements comprise an electrically resistive ink Item 26. The roofing product of Item 24, wherein the heating elements comprise a metal or a metal alloy.

Item 27. The roofing product of Item 24, further comprising a first bus bar and a second bus bar spaced apart from the first bus bar, wherein the heating elements are coupled to the first and second bus bars.

Item 28. The roofing product of Item 27, wherein the first bus bar is electrically connected to first ends of the heating elements, and the second bus bar is electrically connected to second ends of the heating elements that are opposite the first ends.

Item 29. The roofing product of Item 20, wherein the substrate includes trimmable printed indicia.

Item 30. A roofing product can include a substrate, a first heater, and a second heater spaced apart from the first heater. Each of the first and second heaters can be disposed along a principal surface of or within the substrate. The roofing product can have a length>width>thickness, and a product centerline, and the product centerline can be disposed between the first heating section and the second heating section.

Item 31. The roofing product of Item 30, wherein each of the first and second heaters extend no further than approximately 15 cm from the product centerline.

Item 32. The roofing product of Item 30, wherein the product centerline extends substantially along the width.

Item 33. The roofing product of Item 30, wherein the product centerline extends substantially along the length.

Item 34. The roofing product of Item 30, further comprising a third heater disposed on a same side of product centerline as the first heater.

Item 35. The roofing product of Item 34, wherein the first heater is disposed between the centerline and the third heater.

Item 36. The roofing product of Item 35, further comprising a nail zone disposed between the first and third heaters.

Item 37. The roofing product of Item 34, wherein no heater is disposed between the centerline and the third heater.

Item 38. The roofing product of Item 30, wherein the roofing product has a length in a range of approximately 2 meters to approximately 5 meters.

Item 39. The roofing product of Item 38, wherein the roofing product has a length in a range of approximately 3 meters to approximately 4 meters.

Item 40. The roofing product of Item 30, wherein the substrate comprises a polyester, a polyamide, a polyimide, a polyether ether ketone, or a polysulfone.

Item 41. The roofing product of Item 30, wherein the first heater comprises heating elements.

Item 42. The roofing product of Item 41, wherein the heating elements comprise an electrically resistive ink Item 43. The roofing product of Item 41, wherein the heating elements comprise a metal or a metal alloy.

Item 44. The roofing product of Item 41, further comprising a first bus bar and a second bus bar spaced apart from the first bus bar, wherein the heating elements are coupled to the first and second bus bars.

Item 45. The roofing product of Item 44, wherein the first bus bar is electrically connected to first ends of the heating elements, and the second bus bar is electrically connected to second ends of the heating elements that are opposite the first ends.

Item 46. A method of installing a roofing product can include providing a roof having an eaves, and having a first portion and a second portion that intersect to define an intersection; and installing the roofing product over a part of the first portion, the second portion, and the intersection, wherein the roofing product extends along only a portion, and not all, of the intersection, wherein the roofing product includes a first heater.

Item 47. The method of Item 46, wherein installing is performed such that the roofing product is adjacent to the eaves and is spaced apart from an uppermost point of the intersection.

Item 48. The method of Item 47, wherein installing is performed such that the roofing product is at a bottommost point along the intersection.

Item 49. The method of Item 47, wherein installing is performed such that the roofing product extends from a first point adjacent to the eaves to a second point, which from a top view, is over an interior of a structure having the roof.

Item 50. The method of Item 49, wherein the second point is at least approximately 0.2 meters from an exterior wall.

Item 51. The method of Item 49, wherein the second point is no more than 1 meter from an exterior wall.

Item 52. The method of Item 47, wherein the roofing product has a length in a range of approximately 2 meters to approximately 5 meters.

Item 53. The method of Item 52, wherein the length is in a range of approximately 3 meters to approximately 4 meters.

Item 54. The method of Item 46, wherein the first heater comprises a plurality of heating elements.

Item 55. The method of Item 54, wherein the heating elements comprise an electrically resistive ink Item 56. The method of Item 54, wherein the heating elements comprise a metal or a metal alloy.

Item 57. The method of Item 54, further comprising a first bus bar and a second bus bar spaced apart from the first bus bar, wherein the heating elements are coupled to the first and second bus bars.

Item 58. The method of Item 57, wherein the first bus bar is electrically connected to first ends of the heating elements, and the second bus bar is electrically connected to second ends of the heating elements that are opposite the first ends.

Item 59. A method of installing a roofing product can include providing a roof deck having a first portion and a second portion that intersect to define an intersection having an intersection, and installing the roofing product over parts of the first portion, the second portion, and the intersection The roofing product can include a first heater and a second heater; the first heater overlies the first portion and extends no greater than approximately 15 cm from the intersection; and the second heater overlies the second portion and extends no greater than approximately 15 cm from the intersection.

Item 60. The method of Item 59, wherein the roofing product has a product centerline, and installing the roofing product is performed such that the product centerline is substantially parallel to the intersection.

Item 61. The method of Item 60, wherein the product centerline extends substantially along a width of the roofing product.

Item 62. A method of installing a roofing product can include providing a roof deck; installing the roofing product having a heater having a dimension extending in a first direction; and installing a course of shingles over the roof deck and the roofing product, wherein the course of shingles has a height in the first direction, wherein after installing the course of shingles, the dimension of the roofing product is greater than approximately 0.5 times the height of the course of shingles or approximately 20 cm.

Item 63. The method of Item 62, wherein the dimension is greater than approximately 0.5 times the heights of the course of shingles.

Item 64. The method of Item 62, wherein the dimension is greater than approximately 20 cm.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A roofing product, comprising:

a polymeric substrate;

an adhesive layer overlying the substrate;

a release liner overlying the adhesive layer;

a first heater and a second heater; and a metal hinge at least partially embedded within the substrate along a centerline of the roofing product, and wherein the first heater is located on a principal surface of the substrate on a first side of the hinge, wherein the second heater is located on a principal surface of the substrate on a second side of the hinge, wherein the first and second heaters comprise heating elements, wherein the heating elements comprise bus bars extending parallel to the centerline, and wherein the hinge is configured to allow the roofing product to be folded along the hinge to fit into a valley on a roof.

2. The roofing product of claim 1, wherein the substrate comprises a polyester, a polyamide, a polyimide, a polyether ether ketone, or a polysulfone.

3. The roofing product of claim 1, wherein the hinge comprises a metal strip.

* * * * *